US008336239B2

(12) United States Patent
McDermott et al.

(10) Patent No.: US 8,336,239 B2
(45) Date of Patent: Dec. 25, 2012

(54) WRISTBAND AND CLASP THEREFOR

(75) Inventors: Robert McDermott, Sandy, UT (US); Adam Preisach, Saugus, CA (US); Andrew Bishop, Dana Point, CA (US); Tracey Carpentier, Castaic, CA (US); Karen Joseph, Encino, CA (US)

(73) Assignee: St. John Companies, Inc., Valencia, CA (US)

( * ) Notice: Subject to any disclaimer, the term of this patent is extended or adjusted under 35 U.S.C. 154(b) by 0 days.

(21) Appl. No.: 12/606,976

(22) Filed: Oct. 27, 2009

(65) Prior Publication Data

US 2010/0132237 A1 Jun. 3, 2010

Related U.S. Application Data

(63) Continuation-in-part of application No. 11/558,401, filed on Nov. 9, 2006, now Pat. No. 7,631,449.

(51) Int. Cl.

| | |
|---|---|
| ***A44C 5/00*** | (2006.01) |
| ***A44C 1/00*** | (2006.01) |
| ***A44C 17/02*** | (2006.01) |
| ***G09F 3/14*** | (2006.01) |
| ***A44B 1/04*** | (2006.01) |
| ***B65D 63/00*** | (2006.01) |
| ***B65D 67/02*** | (2006.01) |

(52) U.S. Cl. ..... 40/633; 40/665; 40/625; 40/316; 40/300; 40/301; 24/170; 24/173; 24/134 KB; 24/458; 24/545; 24/559; 24/910; 24/129 R; 24/16 PB; 63/20; 63/40; 63/3; 63/3.1; 2/322

(58) Field of Classification Search ..... 40/633, 40/665, 625, 300, 301; 24/170, 173, 134 KB, 24/458, 545, 559, 910, 129 R, 16 PB; 63/40, 63/3, 20, 3.1; 2/322

See application file for complete search history.

(56) References Cited

U.S. PATENT DOCUMENTS 4,078,324 A * 3/1978 Wiebe ..... 40/665

(Continued)

OTHER PUBLICATIONS

Sato DCS & Labeling Worldwide, Product Information DuraMark Wristbands, Sato HealthCARE ID Solutions, 2 pp.

Sato DCS & Labeling Worldwide, Company Information: "The countdown to HIPAA Compliancy. . . ", Sato HealtbCARE ID Solutions, 32 pp.

The St. John Companies, Inc.; "Patient Identification Wristbands"; Patient ID Expert.com; http://www.patientidexpert.com/alert_standardization.html; 11pp.

(Continued)

*Primary Examiner* — Lesley D Morris

*Assistant Examiner* — Syed A Islam

(74) *Attorney, Agent, or Firm* — Christie, Parker & Hale, LLP

(57) ABSTRACT

The field of the present invention relates to an identification assembly, and in particular, to a clasp device for securing to an identification wristband, and to a wristband and clasp assembly. In one embodiment, a identification assembly for a patient includes a band with first and second opposite ends and first and second opposite edges and a width measured between the first and second edges. The identification assembly also includes a clasp secured to the band. The clasp has a first section having an inside surface and an outside surface; a second section having an inside surface and an outside surface, the inside surface of the second section facing the inside surface of the first section; and a protrusion extending from one of the first or the second section to engage the other of the first or the second section to secure the first and second sections together in a closed position. The outside surface of one of the first or the second section comprises a symbol on the outside surface to provide information about the patient. The clasp is color-coded to provide information about the patient.

48 Claims, 12 Drawing Sheets

U.S. PATENT DOCUMENTS

| | | | | |
|---|---|---|---|---|
| 4,783,917 | A | 11/1988 | Smith et al. | |
| 5,115,586 | A * | 5/1992 | Hawker | 40/316 |
| 5,226,809 | A | 7/1993 | Franco | |
| 5,448,846 | A | 9/1995 | Peterson et al. | |
| 5,479,797 | A | 1/1996 | Peterson | |
| 5,577,395 | A | 11/1996 | Kuykendall | |
| 5,758,443 | A * | 6/1998 | Pedrazzini | 40/633 |
| 5,979,095 | A | 11/1999 | Schneider et al. | |
| 6,880,364 | B1 * | 4/2005 | Vidolin et al. | 63/40 |
| 6,907,684 | B2 * | 6/2005 | Volk et al. | 40/300 |
| 7,007,507 | B2 * | 3/2006 | Enevoldsen | 63/3.1 |
| 7,137,216 | B2 * | 11/2006 | Ali et al. | 40/633 |
| 7,197,842 | B2 * | 4/2007 | Ali | 40/633 |
| 7,386,949 | B2 | 6/2008 | Riley | |
| 2008/0028654 | A1 | 2/2008 | Cardon et al. | |

OTHER PUBLICATIONS

Pennsylvania Patient Safety Reporting System; Supplemental Advisory; Use of Color-Coded Patient Wristbands Creates Unnecessary Risk; Patient Safety Advisory; vol. 2, Sup. 2—Dec. 14, 2005; 4pp.

Sato DCS & Labeling Worldwide; SATO HealthCARE ID Solutions; DuraMark Wristbands; Rev. Jul. 2004, 2pp.

Safe & Sound: An Arizona Patient Safety Initiative; Implementation Tool Kit; Color-coded Wristband Standardization in Arizona; Distributed Nov. 2006, 82pp.

PatientIDExpert.com Brought to you by The St. John Companies; Sep. 4, 2008—American Hospital Association Quality Advisory—Implementing Standardized Colors for Patient Alert Wristbands; printed from http://www.patientidexpert.com/alert_standardization.html on May 14, 2009; 11pp.

* cited by examiner 120
130
124
182
186
186
184
192
190
150
132
192
190
126
140

120
140

120
140

120
140

120
140

120
156
140

WRISTBAND AND CLASP THEREFOR

CROSS-REFERENCE TO RELATED ED APPLICATION(S)

This application is a continuation in-part of U.S. patent application Ser. No. 11/558,401, filed on Nov. 9, 2006 now U.S. Pat. No. 7,631,499 and published as U.S. Publication No. 2008-0110069, which is hereby incorporated by reference in its entirety for all purposes as if fully set forth herein.

FIELD OF THE INVENTION

The field of the present invention relates to an identification assembly, and in particular, to a clasp device for securing to an identification wristband, and to a wristband and clasp assembly.

BACKGROUND

Wristbands are used in hospitals to identify patients and for similar purposes in other instructional/institutional settings. In general, a wristband is attached to a patient's wrist or other appendage, such as a patient's ankle, with a fastener. Conventional wristbands have two ends and a plurality of holes along the length of the wristband. Typical fasteners are rectangular with a large footprint and have one or two stems or posts that extend through at least two holes of each end of the wristband to attach the two ends of the wristband together. Some conventional fasteners use one stem through two holes of each end of the wristband to attach the wristband to a patient's wrist. However, the single stem often results in twisting of the wristband on the patient's skin, which can often be uncomfortable. Other conventional fasteners use two stems through two holes of each end of the wristband to inhibit twisting or rotation of one end the wristband relative to the other end while the wristband is attached to a patient's wrist. However, two stems often require a larger sized clasp, which can be cumbersome.

SUMMARY OF THE INVENTION

An identification assembly for a person including a clasp device for securing to an identification wristband is disclosed.

In one embodiment, an identification assembly includes a band (such as a wristband) and one or more clasps that provide information about the patient. The clasps are color-coded, with the color of the clasp indicating information about the patient (such as an allergy), and they are imprinted with words or symbols that also provide information about the patient (such as the words "Allergy" or "No Latex"). The clasps may be used to secure the band into a loop, but they can also be attached to the band without performing that function. Multiple clasps can be secured to the band at various positions along the band to provide the desired information about the wearer. In one embodiment, the clasps are tapered, such as trapezoidal or triangular, so that clasps secured from opposite edges of the band internest in an alternating arrangement, saving space along the wristband and providing a smaller footprint and more comfort for the wearer. In one embodiment, the color-coded, symbol-imprinted clasps are formed as a single integrated piece, such as a continuous molded plastic piece.

In one embodiment, an identification assembly for a person includes a wristband having a display portion and a first fastening portion extending from one end of the display portion and a second fastening portion extending from the other end of the display portion. The first fastening portion includes at least one attachment aperture, and the second fastening portion includes a plurality of attachment apertures arranged along its center line. The assembly includes at least one clasp having a folding base with first and second triangular sections connected together via a hinge that enables the base to be folded along a folding axis from an open position to a closed position so that the first and second triangular sections are adjacently positioned. The at least one clasp includes a securement aperture formed in the first triangular section and a post extending from the second triangular section that couples to the securement aperture when the base is folded along the folding axis in the closed position. The post extends from the second triangular section through the at least one attachment aperture of the first fastening portion and at least one attachment aperture of the second fastening portion of the wristband and couples to the securement aperture of the first triangular section so that the clasp is fastened to the wristband and the first and second fastening portions are attached together.

In one aspect, the at least one clasp is securable to any one of the attachment apertures of the first and second fastening portions. The display portion comprises a flat, rectangular section that is adapted to receive a label or direct print or written information. The fastening portions overlap in a manner such that the attachment apertures of the fastening portions are aligned whereby the post extends through the attachment apertures for securing the fastening portions together. A plurality of clasps are fastened to the wristband, and each clasp is positioned adjacent and proximate to each other in an alternating or interleaving relationship. A plurality of clasps are fastened to the plurality of attachment apertures of the second fastening portion in an alternating or interleaving relationship such that at least one clasp is fastened to at least one attachment aperture from a first edge of the wristband and at least one other clasp is fastened to at least one other attachment aperture from a second edge of the wristband that is opposite of the first edge. Each fastening portion of the wristband has a width that is smaller than the width of the display portion. The fastening portions of the wristband extend from a central region of the display portion so that the width of the fastening portions are centered within the width of the display portion.

In one aspect, the hinge of the clasp is formed integrally with the first and second triangular sections. A portion of an interior surface of the second triangular section is recessed to define a shoulder comprising an anti-rotation or anti-twisting feature. The wristband is secured in position between the post and the shoulder so as to inhibit the wristband from rotating or twisting along the shoulder of the clasp. The assembly includes one or more alignment surfaces that extend from the interior surface of the second triangular section. The one or more alignment recesses may be formed in an interior surface of the first triangular section that receives a portion of the second triangular section when the clasp is folded. At least one of the first and second triangular sections comprise an exterior recess formed in an exterior surface thereof for imprinting an alert message that identifies warnings and other relevant information about the person wearing the wristband. The assembly is made of fabric, plastic or resin material. The identification assembly for a person comprises a patient identification assembly for use with patients in a hospital or medical facility and comprises indicia that identify patients and provide information about those patients. The wristband is secured around the person's appendage such as a wrist or an ankle.

In one embodiment, an identification assembly for a person includes a wristband having at least one attachment aperture and at least one clasp having a folding base with first and second triangular sections connected together via a hinge that enables the base to be folded along a folding axis from an open position to a closed position so that the first and second triangular sections are adjacently positioned. The at least one clasp includes a securement aperture formed in the first triangular section and a post extending from the second triangular section that couples to the securement aperture when the base is folded along the folding axis in the closed position. The post extends from the second triangular section through the at least one attachment aperture of the wristband and couples to the securement aperture of the first triangular section so that the clasp is fastened to the wristband.

In one embodiment, a clasp device for use with a wristband having at least two attachment apertures includes a folding base having a first triangular section connected to a second triangular section and a hinge connecting the first and second triangular sections. The hinge defines a folding axis that enables the base to be folded so that the first triangular section is positioned adjacent to the second triangular section in an overlapping relationship. A securement aperture is formed in the first triangular section, and a post extends from the second triangular section to couple with the securement aperture of the first triangular section when the base is folded along the folding axis. The post extends from the second triangular section through the two attachment apertures of the wristband and couples to the securement aperture of the first triangular section so that the clasp is secured to the wristband.

In one embodiment, a clasp for a wristband having an attachment aperture includes a first triangular section having a securement aperture, a second triangular section having a post, and a hinge that attaches the first triangular section to the second triangular section. The hinge defines a folding axis that enables the clasp to be folded so that the first triangular section is positioned adjacent to the second triangular section. The post extends from the second triangular section through the attachment aperture of the wristband and couples to the securement aperture of the first triangular section so that the clasp is secured to the wristband. In one aspect, the clasp is foldable along the folding axis and folds from an open position to a closed position to secure the clasp to the wristband.

In one embodiment, an identification assembly includes a wristband and a plurality of triangular clasps secured to the wristband. One or more clasps extend from each side of the wristband, and the clasps are internested to take advantage of their triangular relationship and/or configuration. The clasps are coded to indicate information about a person.

In one aspect, the clasps are coded by color. The wristband includes a plurality of holes therein and at least one clasp extends through at least two holes thereby fixing the size of the wristband. Each clasp comprises two triangular sections including a hinge joining the two triangular sections and a post and aperture by which the clasp is secured to the wristband and held in a closed position. The clasps are coded by imprinting with words, symbols or color to indicate information about a person.

In one embodiment, a identification assembly for a patient includes a band with first and second opposite ends and first and second opposite edges and a width measured between the first and second edges, the band being flexible to bring the first and second ends together to form a loop for encircling the patient. The identification assembly also includes a clasp secured to the band. The clasp has a first section having an inside surface and an outside surface; a second section having an inside surface and an outside surface, the inside surface of the second section facing the inside surface of the first section; and a protrusion extending from one of the first or the second section to engage the other of the first or the second section to secure the first and second sections together in a closed position. The outside surface of one of the first or the second section comprises a symbol on the outside surface to provide information about the patient. The clasp is color-coded to provide information about the patient.

In one embodiment, an identification assembly for a patient includes a band with first and second opposite ends and first and second opposite edges, and having a width measured between the first and second edges and an axis extending between the first and second ends, the band being flexible to bring the first and second ends together to form a loop for encircling the patient. The identification assembly also includes a clasp secured to the band. The clasp has a first section having an inside surface and an outside surface; a second section having an inside surface and an outside surface, the inside surface of the second section facing the inside surface of the first section; and a protrusion extending from the inside surface of one of the first or the second section to engage the other of the first or the second section to secure the first and second sections together in a closed position. The first and second sections have a tapered shape such that the first and second sections are asymmetrical about the axis of the band. The first section is an integrally molded plastic piece, having a symbol providing information about the patient on the outside surface of the first section. The clasp is color-coded to provide information about the patient.

In one embodiment, an identification system for use with an identification band to provide information about a person wearing such band is provided. The identification system includes a plurality of first clasps, each first clasp having a first section and a second section that engage each other to close the first clasp with such a band passing between the first and second sections; and a plurality of second clasps, each second clasp having a first section and a second section that engage each other to close the second clasp with such a band passing between the first and second sections. Each of the first clasps comprises a first color and a first symbol that provide information about the person. Each of the second clasps comprises a second color and a second symbol that provide information about the person. The first color is different from the second color, and the first symbol is different from the second symbol.

These and other objects and advantages of the present teachings will become more fully apparent from the following description taken in conjunction with the accompanying drawings.

DETAILED DESCRIPTION OF THE INVENTION

Reference will now be made to the drawings wherein like numerals refer to like parts throughout.

Figure 1:
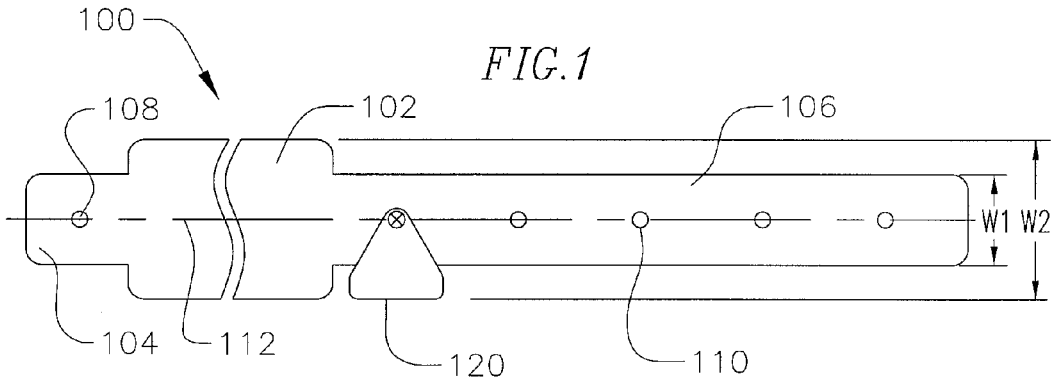
FIG. 1 shows one embodiment of an identification wristband and a clasp device.

An embodiment of a wristband 100, as shown in FIG. 1, has a display portion 102 for displaying identification information and fastening portions 104, 106 with one or more attachment apertures 108, 110 formed therein for securing a clasp, clip or snap device 120 thereto. In one aspect, the fastening portions 104, 106 have a width (w1) that is smaller than a width (w2) of the display portion 102, and the fastening portions 104, 106 extend along a central axis 112 of the display portion 102 of the wristband 100 so that the width (w1) of the fastening portions 104, 106 is centered within the width (w2) of the display portion 102 of the wristband 100.

As shown in FIG. 1, a first fastening portion 104 extends from one end of the display portion 102 and a second fastening portion 106 extends from the other end of the display portion 102. In one embodiment, the first fastening portion 104 of the wristband 100 has a single aperture 108 formed therein, and the second fastening portion 106 of the wristband 100 has a plurality of apertures 110 formed therein arranged along its center line. As shown in FIG. 1, a clasp 120 is securable to any one of the attachment apertures 108, 110 of the fastening portions 104, 106, and the clasp 120 comprises a triangular structure that folds over at least one of the fastening portions 104, 106 of the wristband 100. In general, the display portion 102 of the wristband 100 comprises a flat, rectangular section that is adapted to receive a label or direct print or hand written information, such as an adhesive label, having identification symbols, such as, for example, wording or verbiage, numeric symbols, alphanumeric symbols, barcode symbols and/or pictures.

Figure 2A:
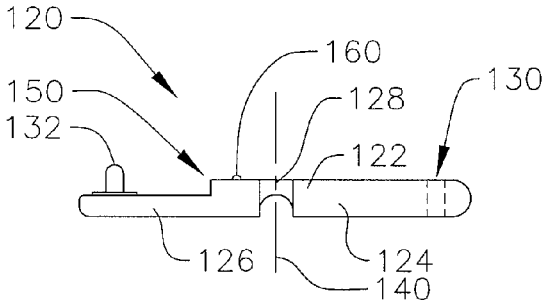
FIG. 2A is a side view of a clasp in an opened position.

As shown in FIGS. 2A-3B, the clasp 120 comprises a folding base 122 having a first triangular plate-like member 124 connected to a second triangular plate-like member 126 via a hinge member 128. A securement aperture 130 is formed in the first triangular section 124, and a post or stem 132 extends from the second triangular section 126 and couples to the securement aperture 130 of the first triangular section 124 when the base 122 of the clasp 120 is folded along a folding axis 140. In one aspect, as shown in FIGS. 2A and 3A, the hinge 128 connects the first and second triangular sections 124, 126 and defines the folding axis 140 that enables the base 122 of the clasp 120 to be folded so that the first triangular section 124 is positioned adjacent to the second triangular section 126 in an overlapping relationship. In another aspect, the post 132 extends from the second triangular section 126 through at least one attachment aperture 108, 110 of the wristband 100 and couples to the securement aperture 130 of the first triangular section 124 so that the clasp 120 is secured to the wristband 100.

In one embodiment, the post 132 comprises a single post that extends from the second triangular section 126 to couple or interlock with the securement aperture 130, which comprises a single aperture formed in the first triangular section 124.

In one aspect, the hinge 128 is formed integrally with the first and second triangular sections 124, 126 to form the folding base 122 of the clasp 120, and the hinge 128 is foldable along the folding axis 140 so that the first and second triangular sections 124, 126 can be positioned adjacent and proximate to each other. The entire clasp can be molded as a single integral plastic piece.

A portion of an interior surface of the second triangular section 126 is recessed to define an abutment ridge or shoulder 150 serving as an anti-rotation or anti-twisting feature. In one aspect, the shoulder 150 forms a straight-edged ridge or shoulder that receives an edge of at least one fastening portion 104, 106 of the wristband 100, and the wristband 100 is secured in position between the post 132 and the shoulder 150 when the clasp 120 is folded so as to inhibit the wristband 100 from rotating, twisting or pivoting along or about the shoulder 150.

Figure 3A:
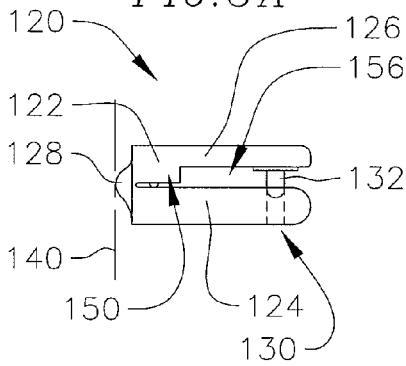
FIG. 3A is a side view of the clasp in a closed position.

As shown in FIG. 3A, when the clasp 120 assumes its closed position, a gap 156 adjacent to the shoulder 150 is formed between the first and second triangular sections 124, 126 so as to receive at least one fastening portion 104, 106 of the wristband 100. In general, when the clasp 120 is secured to at least one attachment aperture 108, 110 of the wristband 100, the at least one fastening portion 104, 106 of the wristband 100 is biased between the post 132 and the shoulder 150 of the clasp 120. In one aspect, because of the stabilizing effect of the shoulder 150, only one part is needed on each clasp.

The clasp 120 includes one or more alignment features 160 that protrude from the interior surface of the second triangular portion 126 adjacent to the hinge 128. The clasp 120 also includes one or more alignment recesses 162 formed in an interior surface of the first triangular section 124 that receive alignment features 160 of the second triangular section 126 when the clasp 120 is folded. In one embodiment, the clasp 120 comprises a fabric, plastic or resin material, and the clasp 120 comprises a solid color, such as, for example, red, purple, green, pink, yellow, orange and blue. In one embodiment, the clasp is formed of a glow-in-the-dark color or material. It should be appreciated by those skilled in the art that the clasp 120 may have any shade of color or transparency of color without departing from the scope of the clasp 120. In addition, the clasp 120 may have one solid color or multiple colors. Each color can indicate a condition or procedure that applies to the individual patients.

The second triangular section 126 comprises an exterior recess 170 formed in an exterior surface thereof for, as an alternative to relying on color, permanently imprinting or scoring an alert message or verbiage that identifies warnings, such as, for example, an allergy, a do-not-resuscitate (DNR)

directive and a fall risk. It should be appreciated by those skilled in the art that the exterior recess 170 may be formed in an exterior surface of the first triangular section 124 or both the first and second triangular sections 124, 126 without departing from the scope of the clasp 120. In addition, a removable or temporary label or sticker may be used for the alert message, symbol or verbiage. Moreover, identification information may be handwritten without departing from the scope of the present invention.

Figure 4A:
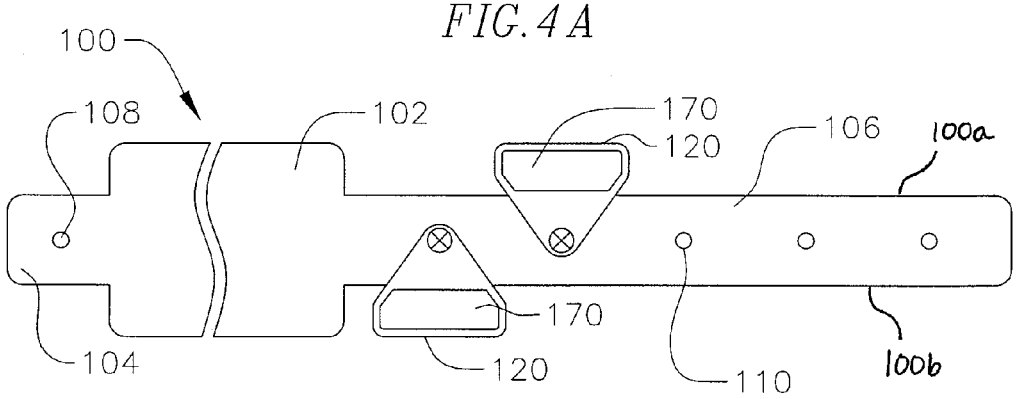
FIGS. 4A and 4B show various embodiments of a plurality of clasps mounted or secured to the wristband.
Figure 4B:
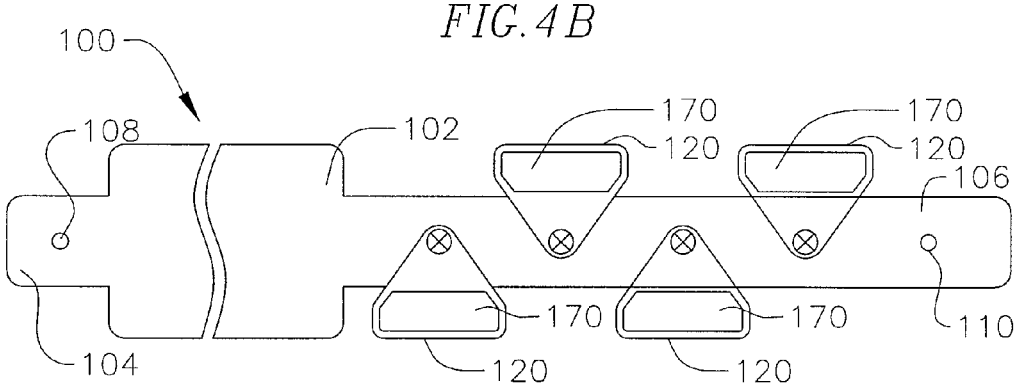

FIGS. 4A and 4B show various embodiments of a plurality of clasps 120 mounted or secured to the wristband 100. As shown in FIG. 1, a single clasp 120 can be secured to the wristband 100. As shown in FIG. 4A, two clasps can be secured to the wristband 100. As shown in FIG. 4B, four clasps can be secured to the wristband 100. It should be appreciated by those skilled in the art that any number of clasps 120 may be secured to the wristband 100 without departing from the scope of the assembly of one or more clasps 120 to the wristband 100. In one embodiment, FIGS. 1, 4A, and 4B show an assembly comprising the wristband 100 and the plurality of triangular clasps 120 secured to the wristband 100.

As shown in FIGS. 4A and 4B, a plurality of clasps 120 can be positioned on opposite sides of the wristband 100 and adjacent and proximate to each other in an alternating or interleaving manner. The triangular structure or shape of the clasps 120 and the single post securing feature enables for a smaller footprint for the triangular clasps 120 when secured to the wristband 100 along its length. The alternating or interleaving pattern of the triangular clasps 120 secured to the wristband 100 enables for more clasps 120 to be attached to the fastening portion 106 of the wristband 100. This allows a caregiver or patient care technician to safely indicate one or more alert messages. It should be appreciated that the clasps may communicate via color, words or other indicia any type of message the user would like to communicate on the wristband 100 for a particular person or patient depending on the person's or patient's individual needs. The clasp's smaller footprint is also more comfortable for the patient to wear.

Figure 5:
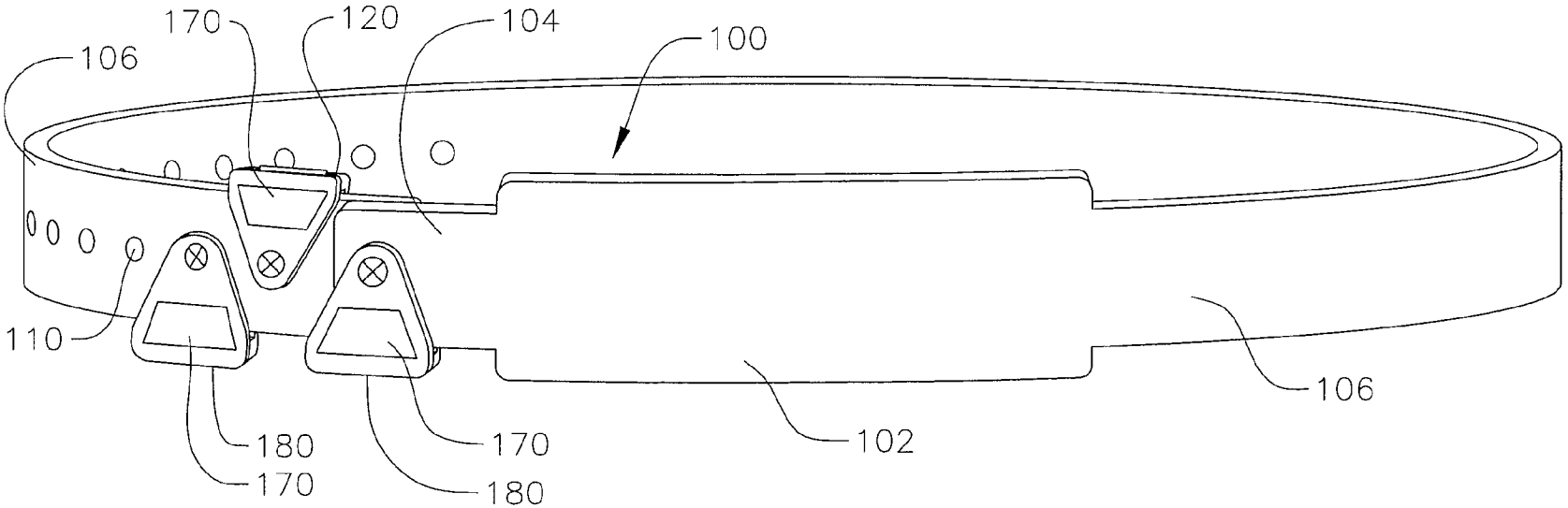
FIG. 5 is a perspective view of the wristband with fastening portions of the wristband secured together via the clasp.

As shown in FIG. 5, the wristband 100 has fastening portions 104, 106 of the wristband 100 secured together via the clasp 180, which is the same as clasps 120. In one embodiment, the wristband 100 and clasp 120 comprise an identification assembly for securing the wristband 100, as an identification wristband, to a client via the clasp 120. It should be appreciated that clasp 120 has multiple functions including securing the wristband 100 to a person or patient and also indicating information about the person or patient, wherein one of the clasps 120 may be used to secure the wristband 100 to the person or patient and one or more additional clasps 120, including the securing clasp 120, may be used for patient identification or treatment information for review by the caregiver.

Referring to FIGS. 2A and 5, the post 132 of the clasp 180 extends from the second triangular section 126 of the clasp 180 through the attachment apertures 108, 110 of the fastening portions 104, 106 of the wristband 100 and couples to the securement aperture 130 of the first triangular section 124 of the clasp 180 so that the clasp 180 secures the fastening portions 104, 106 of the wristband 100 together. As shown in FIG. 5, the fastening portions 104, 106 of the wristband 100 overlap in a manner such that the attachment apertures 108, 110 of the fastening portions 104, 106 are aligned whereby the post 132 of the clasp 180 can be extended through the two attachment apertures 108, 110 for securing the two fastening portions 104, 106 of the wristband 100 together. In general, the securing clasp 180 in this manner enables the wristband 100 to be secured around, for example, an appendage, such as an arm, wrist, leg or ankle of a client, such as a person or a patient, for identification purposes. In one aspect, the plurality of the clasps 120, 180 function as identifying elements of the wristband 100 to warn or alert a patient caregiver of alert messages or verbiage that identifies, for example, warnings, such as, for example, allergies, various types of directives, such as DNR, and fall risk. It should be appreciated by those skilled in the art that the aperture 108 of the fastening portion 104 can be attached or coupled to any one of the apertures 110 of the fastening portion 106 via the clasp 120, 180 without departing from the scope of the clasp 120, 180 or the wristband 100.

As shown in FIGS. 4A, 4B and 5, a plurality of clasps 120 can be fastened to the wristband 100, and each clasp can be positioned adjacent and proximate to each other in an alternating or interleaving relationship. The wristband 100 includes a plurality of attachment apertures 108, 110, and the plurality of clasps 120 can be fastened to the plurality of attachment apertures 108, 110 of the wristband in an alternating or interleaving relationship such that at least one clasp can be fastened to at least one attachment aperture 108, 110 from a first edge 100*a* of the wristband 100 and at least one other clasp 120 can be fastened to at least one other attachment aperture 108, 110 from a second edge 100*b* of the wristband 100 that is opposite of the first edge. In one aspect, the identification assembly for a person includes a patient identification assembly for use with patients in a hospital or medical facility and includes indicia or coding that identifies different treatments, warnings and/or alerts for patients. As shown in FIG. 5, the wristband 100 has holes or apertures 108, 110 formed therein, and at least one clasp 120 extends through at least two holes 108, 110 thereby fixing the size of the wristband 100.

Moreover, as shown in FIGS. 4A, 4B and 5, one or more clasps 120 may extend from each side or edge (100*a*, 100*b*) of the wristband 100, and the clasps 120 are interleaved or internested thereby taking advantage of their triangular configuration. In one aspect, the triangular clasps 120 fit together in an alternating manner. For example, as shown in FIGS. 4A, 4B and 5, two triangular clasps 120 extending from one edge 100*a* of the wristband 100 are positioned side-by-side in a manner to form a triangular gap or space where another triangular clasp 120 extending from the opposite edge 100*b* of the wristband 100 is received within the gap or space formed between the other two triangular clasps 120. This configuration allows a plurality of clasps 120 to be interleaved or internested along the length of the wristband 100 in an alternating manner. In one aspect, the clasps 120 can be coded to indicate information about a person or a patient, wherein each of the clasps 120 are coded, for example, by a color, symbol and/or verbiage or a plurality of different colors, symbols and/or verbiage.

Figure 2B:
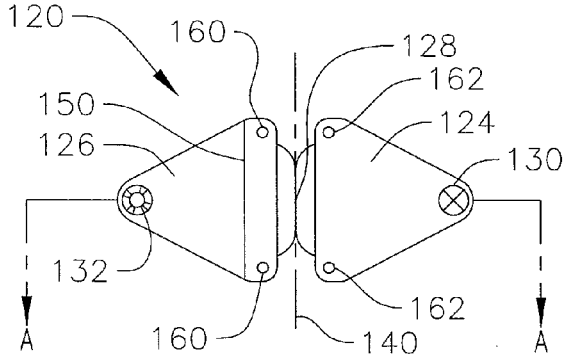
FIG. 2B is a top view of the clasp in the opened position.
Figure 3B:
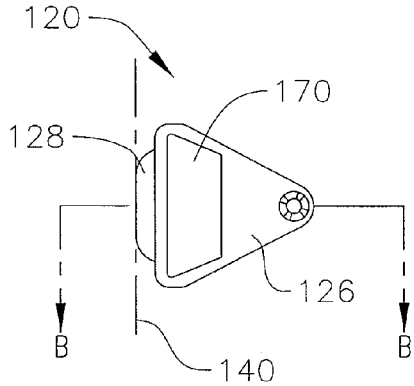
FIG. 3B is a top view of the clasp in the closed position.
Figures 6A, 6B, 6C, 6D, 6E, 6F:
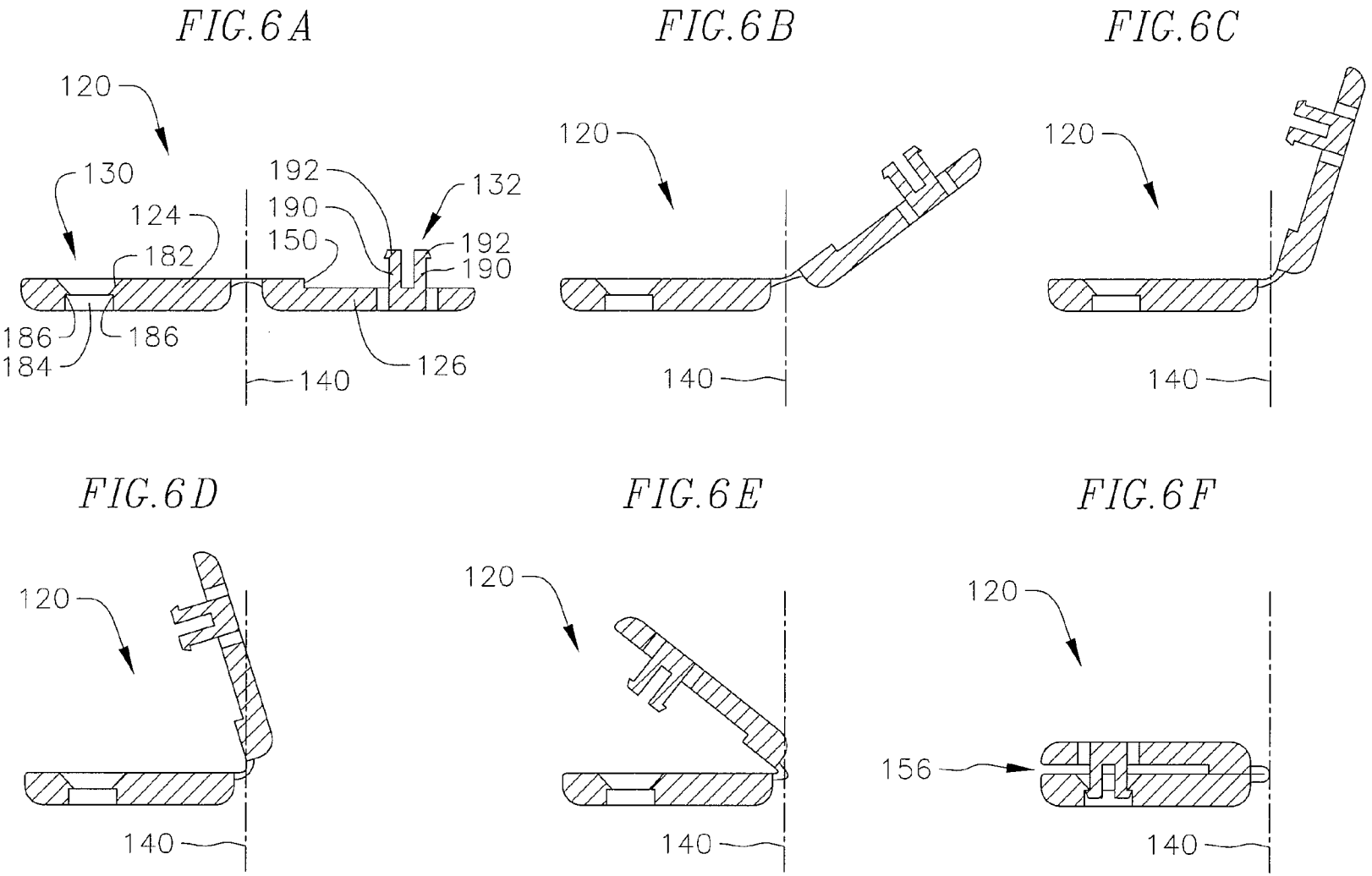
FIGS. 6A-6F are cross-sectional views of the clasp in various positions during folding of the clasp along a folding axis from the opened position to the closed position.

As shown in FIG. 6A, the clasp 120 is configured in an opened position taken along the lines A-A of FIG. 2B. As shown in FIG. 6F, the clasp 120 is configured in a closed position taken along the lines B-B of FIG. 3B. As shown in FIGS. 6B-6E, the clasp 120 is configured in various positions during folding of the clasp 120 along the folding axis 140 from the opened position of FIG. 6A to the closed position of FIG. 6F.

In one embodiment, as shown in FIG. 6A, the securement aperture 130 of the first triangular section 124 comprises a chamfered portion 182 and a coupling portion 184 having a tab region 186 that extends therefrom to receive the post 132 of the second triangular section 126. As shown in FIG. 6A, the post 132 of the second triangular section 126 comprises an elongate portion 190 having a clip region 192 that couples to the tab region 186 of the securement aperture 130. In one aspect, the securement aperture 130 and the post 132 are similarly circular or cylindrical in shape so as to communicate with each other for coupling to each other. In another aspect, the post 132 may comprise a slotted post with a plurality of sides or ribs along the length of the post 132.

In one embodiment, the elongated region 190 of the post 132 is flexible so that, during coupling of the post 132 to the securement aperture 130, the elongate region 190 of the post 132 moves or slides through the chamfered portion 182 and couples with the tab region 186 of the securement aperture 130 for securing the clip region 192 of the post 132 to the tab region 186 of the securement aperture 130, as shown in FIG. 6F. In one aspect, it should be appreciated by those skilled in the art that coupling or connecting the securing post 132 to the securement aperture 130 is permanent and tamper evident when removed, wherein the wristband 100 must be cut-off when removed from the patient, for example.

Figure 7A:
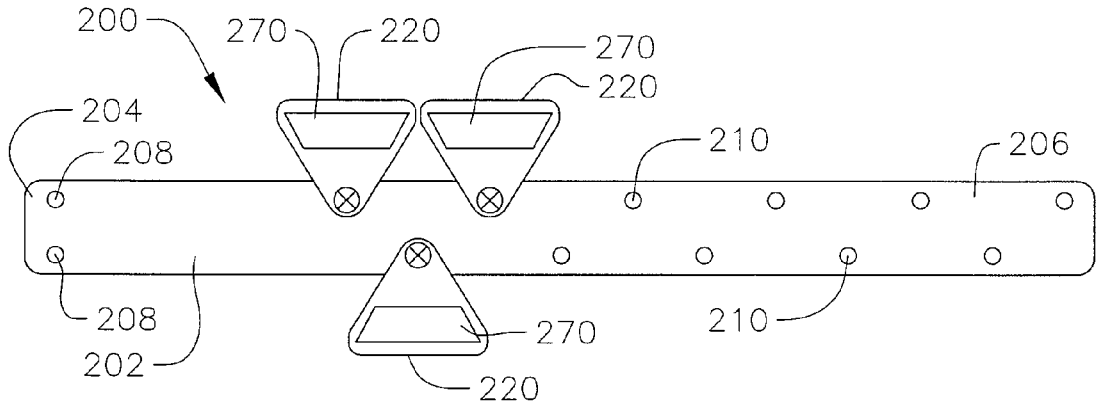
FIG. 7A shows another embodiment of a wristband.

As shown in FIG. 7A, another embodiment of a wristband 200 has a display portion 202 for displaying identification information and fastening portions 204, 206 with a plurality of attachment apertures 208, 210 formed therein for securing a clasp, clip or snap device 220 thereto. In one aspect, the fastening portions 204, 206 comprise the same width as the width of the display portion 202, and the fastening portions 204, 206 extend from the display portion 202 of the wristband 200.

As shown in FIG. 7A, a first fastening portion 204 extends from one end of the display portion 202 and a second fastening portion 206 extends from the other end of the display portion 202. In one embodiment, the first fastening portion 204 of the wristband 200 comprises at least two apertures 208 formed therein, and the second fastening portion 206 of the wristband 200 comprises a plurality of apertures 210, such as, for example, staggered apertures, formed therein. As shown in FIG. 7A, the clasp 220 is securable to any one of the apertures 208, 210 of the fastening portions 204, 206, and the clasp 220 comprises a triangular structure that folds over at least one of the fastening portions 204, 206 of the wristband 200. In general, the display portion 202 of the wristband 200 comprises a flat, elongated section that is adapted to receive a label, direct print or handwritten info, such as an adhesive label, having identification symbols, such as, for example, verbiage, wording, numeric symbols, alphanumeric symbols, graphic symbols and/or barcode symbols.

Figure 7B:
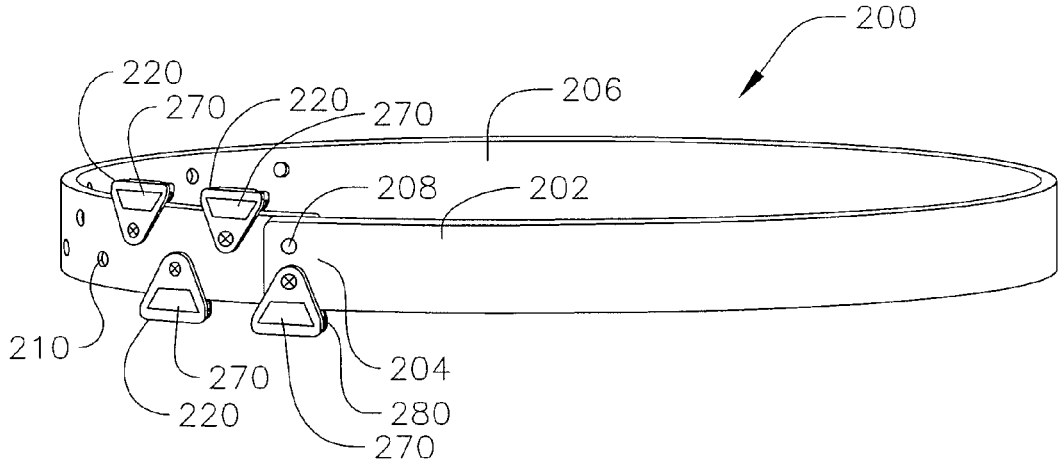
FIG. 7B is a perspective view of the wristband of FIG. 7A with fastening portions of the wristband secured together via the clasp.

FIG. 7B is a perspective view of the wristband 200 with the fastening portions 208, 210 of the wristband 200 secured together via the clasp 280, which is the same as clasps 220. The clasp 280 of FIG. 7B is similar to the clasp 180 of FIG. 5, and therefore, the scope and function of clasps 180, 280 are similar. In general, securing the clasp 280 enables the wristband 200 to be secured around, for example, an arm or wrist of a client, such as a person or patient, for identification purposes. Hence, in one embodiment, the wristband 200 and the clasp 220 comprise an identification assembly for securing the wristband 200, such as an identification wristband, to a client via the clasp 220.

In one aspect, the plurality of clasps 220, 280 function as identifying elements of the wristband 200 to warn or alert a patient caregiver of alert messages or verbiage that identifies warnings, such as, for example, allergies, various types of directives, such as DNR and fall risks. It should be appreciated by those skilled in the art that the aperture 208 of the fastening portion 204 can be attached or coupled to any one of the apertures 210 of the fastening portion 206 via the clasp 220, 280 without departing from the scope of the clasp 220, 280 or the wristband 200.

It should be appreciated that wristbands 100, 200 of FIGS. 1 and 7A can be formed sequentially end-to-end and wound as a reel. This allows the reel of wristbands 100, 200 to be positioned in a printer and printed on one by one in a sequential manner and then detached from the reel one by one in a sequential manner for application to a client or patient. Wristbands may also be imaged on sheets and printed one by one and removed from the sheets when ready to place on the patient or client.

Figure 8:
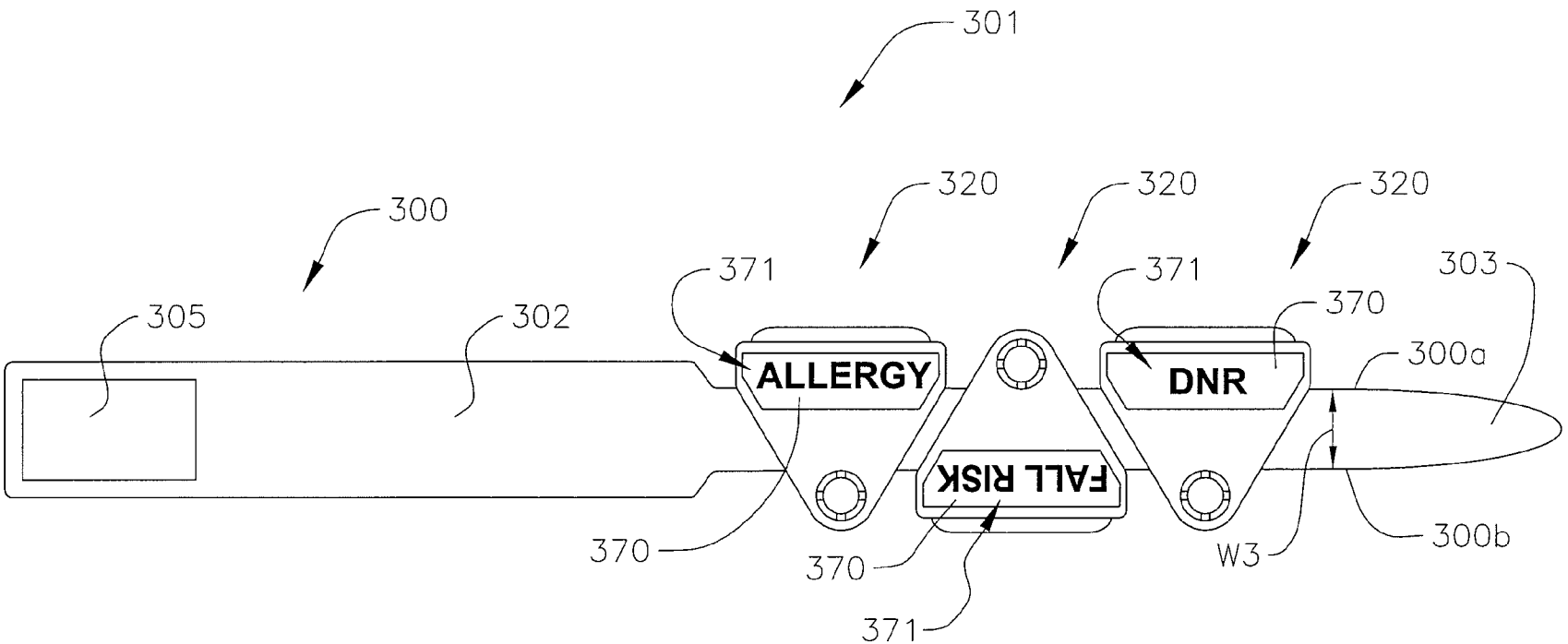
FIG. 8 is a top view of a wristband and clasps according to an embodiment of the invention.

Another embodiment of the invention is shown in FIG. 8. Throughout the application, like reference numbers are used to refer to like features or components. In this embodiment, an identification assembly 301 includes a band 300 and a plurality of clasps 320. The band 300 includes a display portion 302, a strap portion 303, and an adhesive closure 305. To close the wristband into a loop about a person or object, the strap portion 303 is brought around to the adhesive closure 305 and adhered to the closure 305 to secure the band 300 into a loop. The band is flexible to curve into this loop. The band 300 does not include any apertures or openings (such as, for example, attachment apertures 108, 110 in the wristband 100 of FIG. 1). Because the adhesive closure 305 is used to secure the band 300 into a loop, the wristband does not rely on openings or apertures that align to accept a clasp to secure the wristband into a loop.

The clasps of the present invention can be utilized with wristbands such as band 300 that do not include any apertures along the length of the wristband. These wristbands can include bands with various types of adhesive closures, or integrated mechanical closures, or cinch-type closures with a single slot, or any other various types of wristbands without a series of apertures such as apertures 108, 110 in FIG. 1. The clasps 320 can be secured to the band away from the band's closure.

As shown in FIG. 8, the identification assembly 301 includes a plurality of clasps 320 that are secured to the band 300. The clasps 320 extend all the way across the width W3 of the band 300, from one side edge 300*a* to the other side edge 300*b*. By extending across the band, the clasps 320 can attach to the band 300 without passing through a hole or aperture in the band.

In the embodiment shown, the strap portion 303 has a smaller width W3 than the display portion 302, and the strap portion 303 is centered with respect to the display portion 302. The clasps 320 are sized to extend across the strap portion 303 and securely fasten. In other embodiments, the wristband may have a constant width along its length, such as the wristband 200 in FIGS. 7A-B. The clasps 320 are sized to correspond to the width of the wristband being used, so that the clasps 320 extend across the width of the wristband to fasten. In one embodiment, various clasps of different sizes are provided to be used with various wristbands of different widths.

The clasps 320 include one or more recesses 370 on an exterior surface of the clasp, for receiving imprinted, molded, adhered, or written symbols, words, letters, numbers, or other information 371, such as, for example, a color or word that provides a warning about the patient (such as "allergy", "fall risk", and "DNR" do not resuscitate warnings).

Figure 9A:
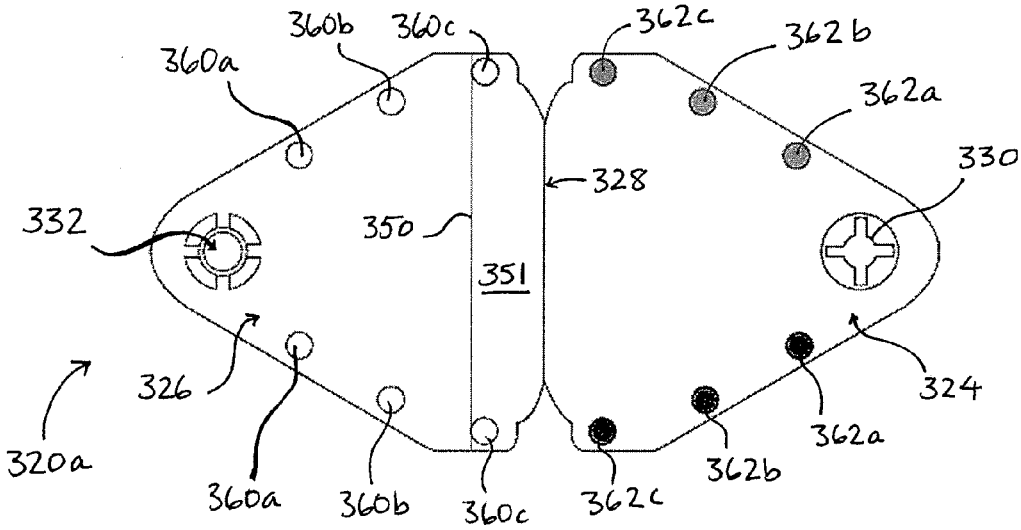
FIG. 9A is a top view of a clasp in an open position, according to an embodiment of the invention.
Figure 9B:
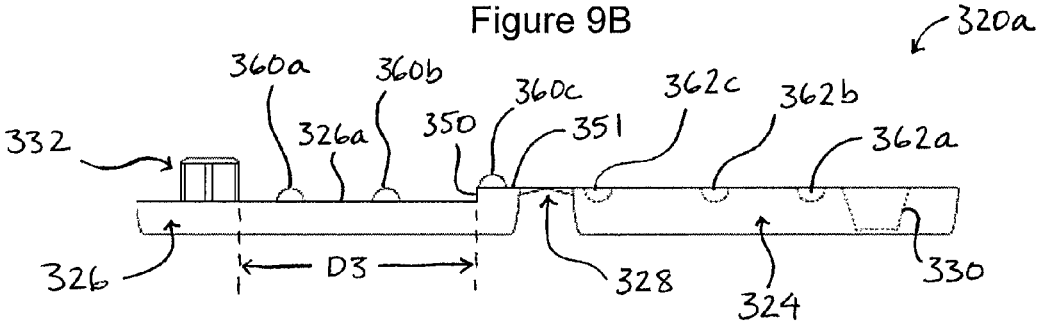
FIG. 9B is a side view of the clasp of FIG. 9A.
Figure 9C:
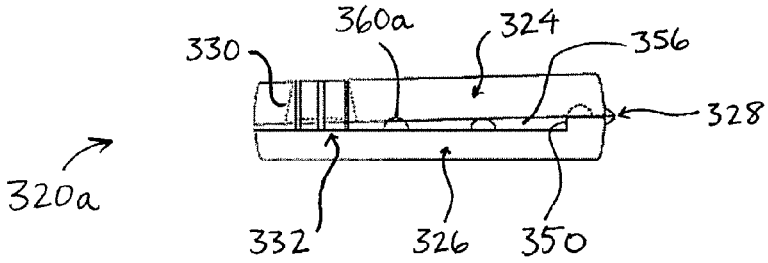
FIG. 9C is a side view of the clasp of FIG. 9A in a closed position.

Turning to FIGS. 9A-C, a clasp 320*a* is shown in both an opened and a closed position. The clasp 320*a* includes two sections 324, 326 connected by a hinge 328. The section 326 includes a shoulder 350 defining a shelf 351 that is raised above the level of the inside surface 326*a* of the section 326

(see FIG. 9B). The shoulder 350 and shelf 351 are optional, and in other embodiments they are not present, such that the inside surface 326*a* is at one level. The section 326 also includes a protrusion such as post 332 that is positioned and sized to engage a depression such as aperture 330 in section 324, to close the clasp 320*a*.

The inside surface 326*a* of the section 326 includes one or more alignment protrusions 360. In this embodiment, six protrusions 360 are spaced apart near the side edges of the section 326. These protrusions 360 are formed as small domes that extend up from the surface 326*a*. In other embodiments they can have other shapes, outlines, and sizes. The inside surface 324*a* of section 324 includes corresponding alignment recesses 362. The recesses 362 and protrusions 360 are positioned on the respective sections 324, 326 so that they align when the clasp 320*a* is folded closed.

The alignment protrusions and recesses assist in clamping the band 300 between the sections 324, 326 of the clasp 320*a*. The band 300 passes over protrusions 360*a*, 360*b*, passing between these protrusions 360*a*, 360*b* and their respective recesses 362*a*, 362*b*. The band 300 is gripped between the protrusions 360*a*, 360*b* and recesses 362*a*, 362*b*, thereby providing additional friction that prevents the band from sliding within the clasp 320*a*.

In one embodiment including the shoulder 350 and shelf 351, the protrusion 360*c* is aligned with the shoulder 350. The edge (300*a* or 300*b*) of the band 300 contacts the side of the protrusions 360*c* and the side of the shelf 351. These protrusions 360*c* and shoulder 350 prevent the wristband from twisting through the clasp 320*a*. The number, size, shape, position, and spacing of protrusions 360 and recesses 362 can be varied and is not limited to the arrangement shown in FIGS. 9A-C (for example, see discussion of FIGS. 10A-B and 11A-B, below).

As mentioned above, the clasp 320*a* passes across the band 300, from one edge 300*a* to the other 300*a*, to close the clasp 320*a*. The post 332 engages the aperture 300 to secure the clasp 320*a* into the folded position, with the band 300 passing through the clasp 320*a*. The distance D3 between the post 332 and the shoulder 350 (or between the post and the hinge 328, if no shoulder is present) should be large enough to receive the band 300. Thus, in one embodiment, the distance D3 between the shoulder 350 and post 332 is at least the same as the width W3 of the strap portion 303, so that the strap portion 303 can fit inside the clasp 320. In one embodiment, the distance D3 is larger than the width W3, in order to enable the clasp 320*a* to easily fit across the band 300. In one embodiment, the distance D3 is substantially the same as the width W3, so that the band 300 is firmly secured between the post 332 and the shoulder 350 (although D3 may be slightly larger than W3 for ease of use and manufacturing tolerances). In this case, the band 300 does not have any extra space or clearance to twist or move within the clasp 320*a*.

The two sections 324, 326 of the clasp 320 are secured to each other at both opposite edges 300*a*, 300*b* of the band, to close the clasp 320 about the band. That is, the sections 324, 326 are secured to each other at a first securement point at one edge 300*a* and a second securement point at the second edge 300*b*. In the embodiments of FIGS. 8-9, the first securement point is the hinge 328, which secures the two sections together at one edge of the band, and the second securement point is the engagement of the post 332 and aperture 330, which secures the two sections together at the other edge of the band. The distance between these two securement points should be greater than the width of the band, so that the band can fit between the securement points.

Figure 10A:
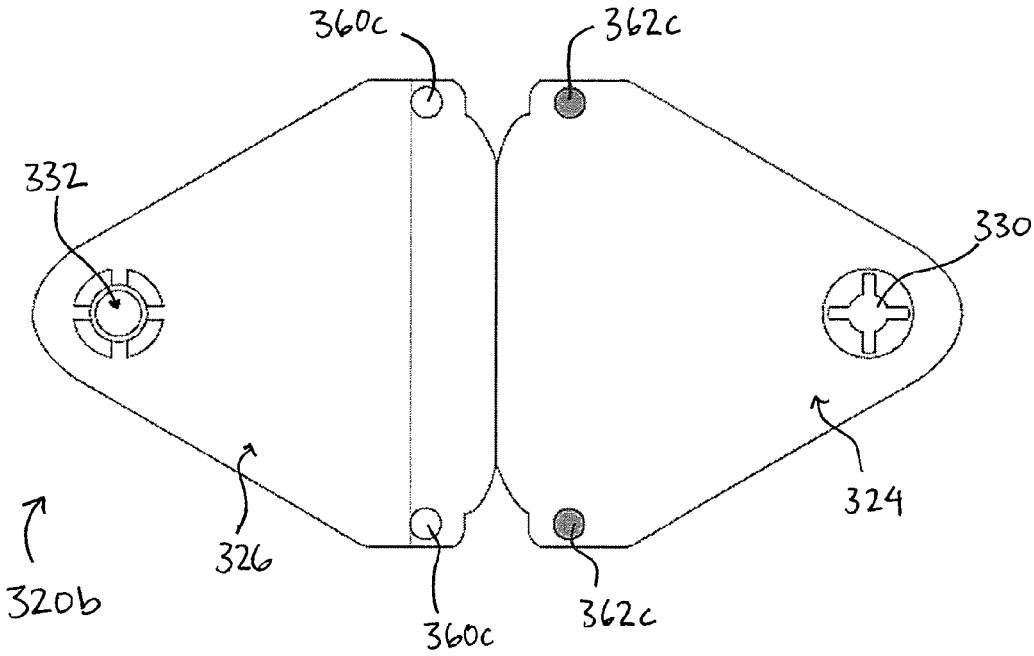
FIG. 10A is a top view of a clasp in an open position, according to an embodiment of the invention.
Figure 10B:
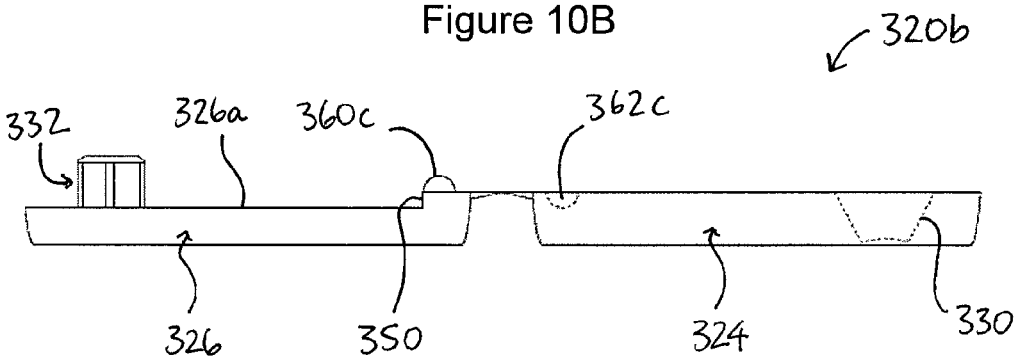
FIG. 10B is a side view of the clasp of FIG. 10A.

A clasp 320*b* according to another embodiment is shown in FIGS. 10A-B. This clasp 320*b* includes only two alignment protrusions 360*c* and matching alignment recesses 362*c*. The alignment protrusions 360*c* are positioned on the shelf 351. The side edge of the protrusion 360*c* lines up with the shoulder 350. The band 300 is positioned along the shoulder 350, which prevents the band 300 from twisting within the clasp 320*b*. However, the remainder of the inside surface 326*a* of the section 326 is flat, without any additional protrusions. The clasp 320*b* shows that many different variations in the spacing and positioning of the protrusions 360 and recesses 362 are possible.

Figure 11A:
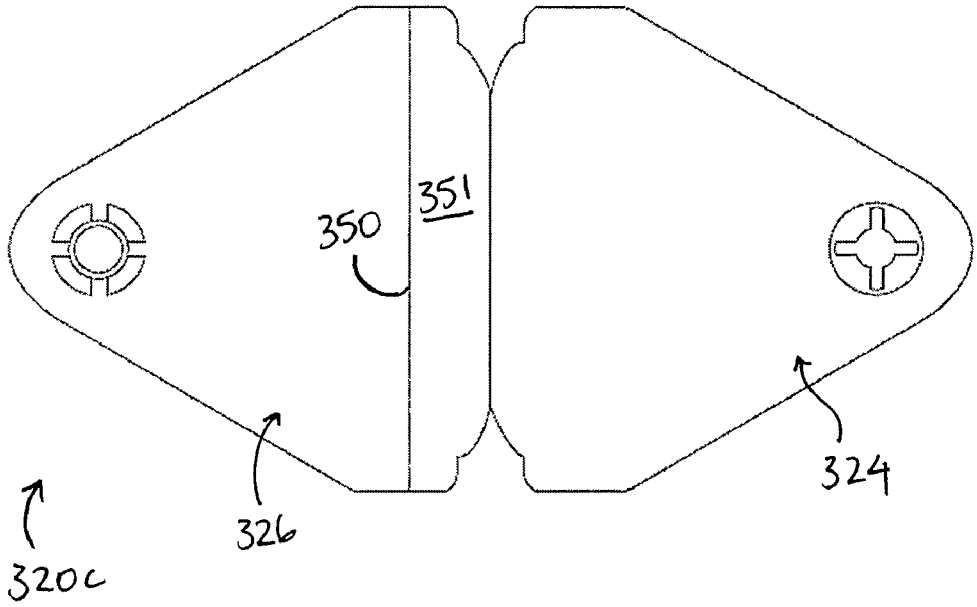
FIG. 11A is a top view of a clasp in an open position, according to an embodiment of the invention.
Figure 11B:
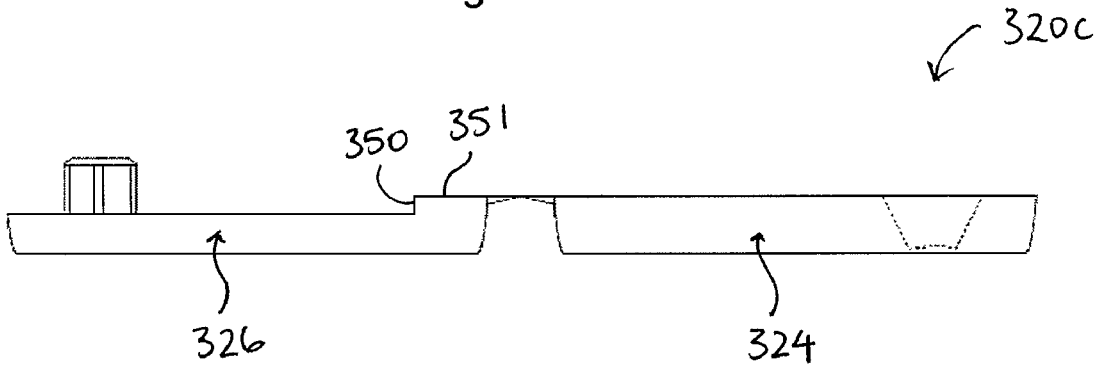
FIG. 11B is a side view of the clasp of FIG. 11A.

Another clasp 320*c* according to another embodiment is shown in FIGS. 11A-B. This clasp 320*c* does not include any alignment protrusions or recesses. While a shoulder 350 and shelf 351 are shown, these too are optional.

Additionally, while each of these clasps 320 is shown with a hinge, the two sections 324, 326 can be connected in other ways, such as by a tether, rather than a hinge. The two sections 324, 326 can be integrally molded as one continuous piece, including a hinge or tether. Alternatively, the two sections 324, 326 can be formed separately, as two separate pieces. In that case, the sections may include a second or third protrusion (such as a post) and a corresponding depression (such as an aperture) at each corner or each side of the clasp, so that the sections 324, 326 can be connected to each other at each side edge of the band 300. That is, on each edge 300*a*, 300*b* of the band, the sections 324, 326 can be connected to each other by a post/aperture or other mechanical mating. The sections 324, 326 may be connected by an adhesive on the inside surface of one or both of the sections, or by mating hook and loop surfaces.

Figure 12:
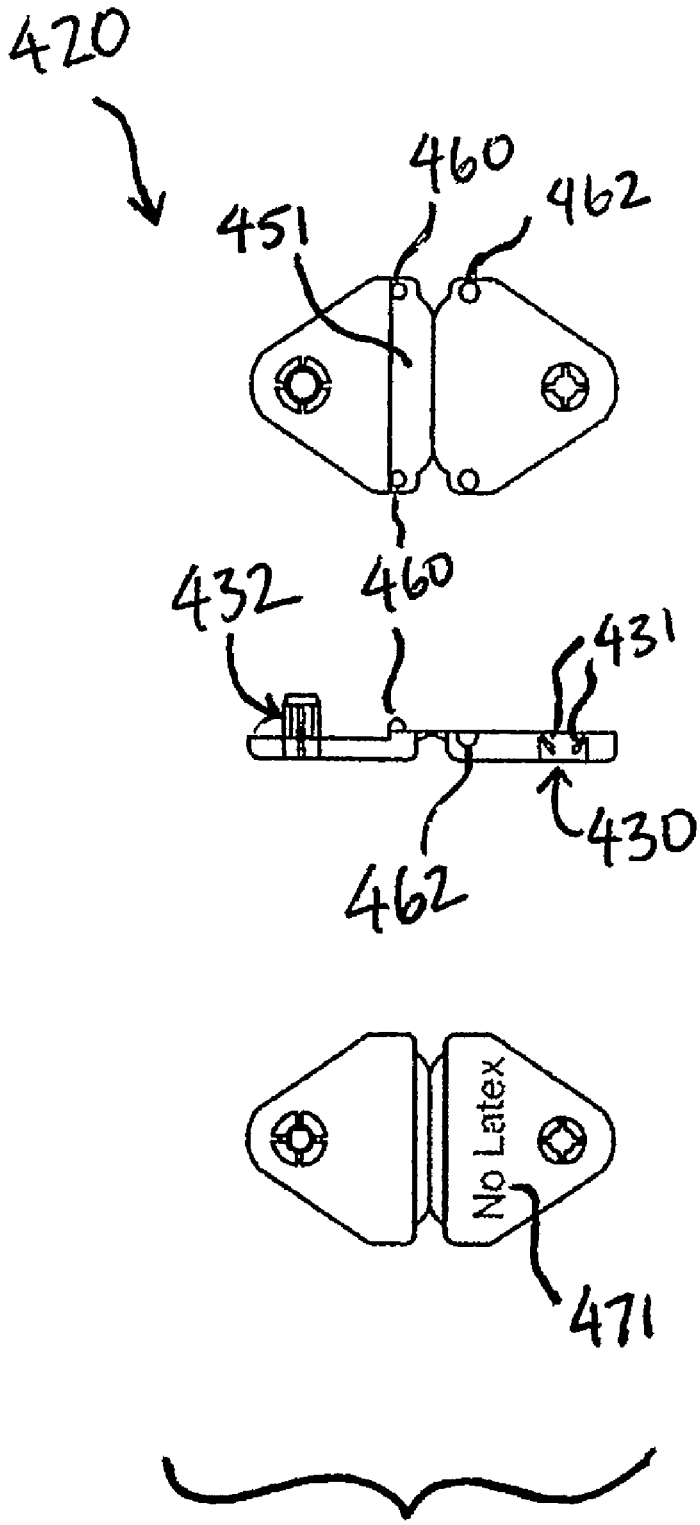
FIG. 12 is a top, side, and bottom view of a clasp in an open position, according to an embodiment of the invention.
Figure 13:
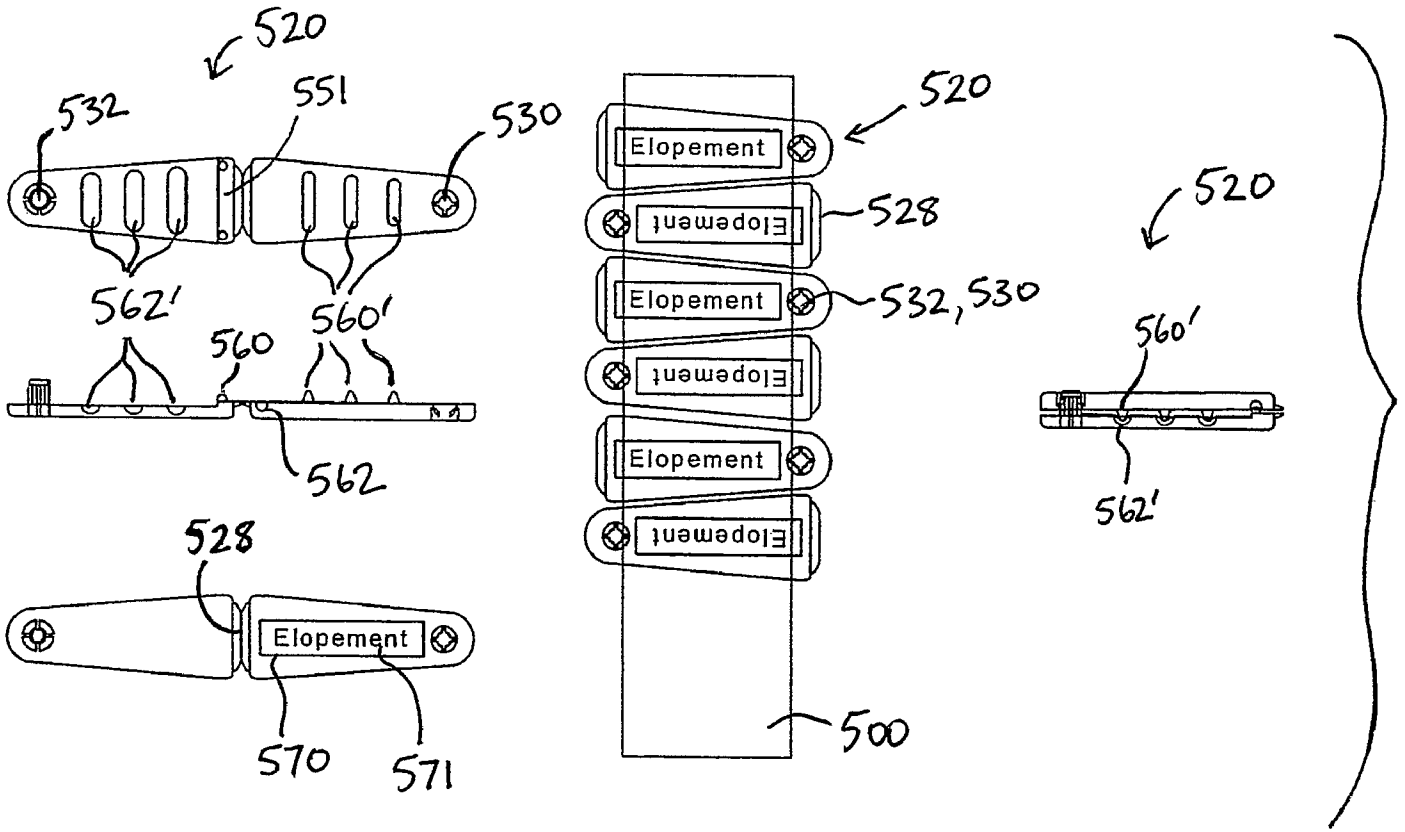
FIG. 13 includes a top, side, and bottom view of a clasp in an open position, a top view of the clasps attached to a band, and a side view of the clasp in a closed position, according to an embodiment of the invention.
Figure 14:
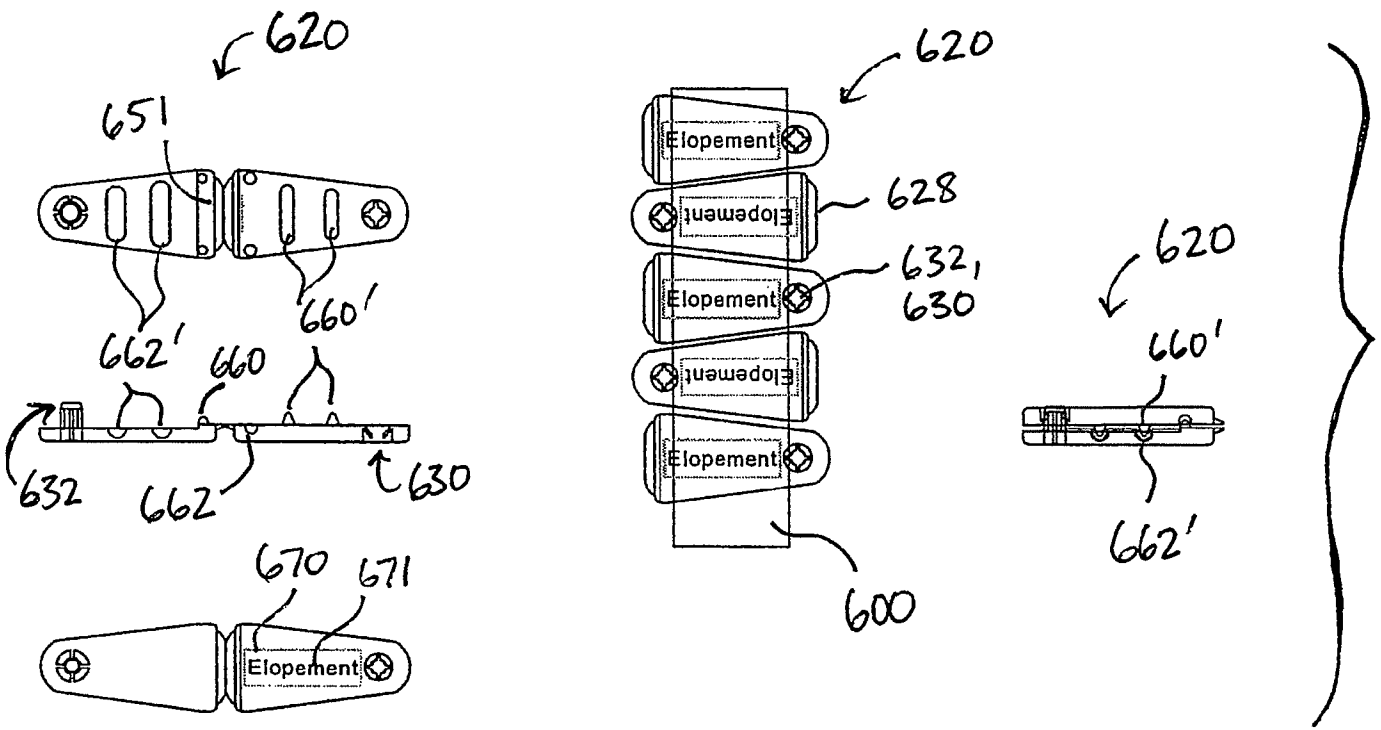
FIG. 14 includes a top, side, and bottom view of a clasp in an open position, a top view of the clasps attached to a band, and a side view of the clasp in a closed position, according to an embodiment of the invention.

FIGS. 12-14 show alternate embodiments of the invention, demonstrating the different sizes and shapes the clasp device can take. The clasp 420 in FIG. 12 is triangular, with three substantially equal sides. The clasp 420 includes a projection 432 that is received into an aperture 430, which has arms 431 that deflect to receive and trap the projection 432. The clasp also includes alignment protrusions 460 and recesses 462, and imprinted information 471.

The clasp 520 in FIG. 13 has a more elongated shape, with tapered sides forming an elongated triangle. The clasp 520 fits across a band 500, with the hinge 528 on one side edge of the band and the prong 532 and aperture 530 on the other side edge of the band. The clasp 520 includes an alignment ridge 560' and corresponding alignment channel 562' on the inside surfaces of the clasp. The ridges 560' align with the channels 562' when the clasp is closed, trapping the band 500 between them. The clasp also includes two alignment protrusions (shaped as domes) 560 and corresponding alignment recesses 562 on the shelf 551.

The clasp 620 in FIG. 14 is shorter in length than the clasp 520, and is designed to fit across a band 600 that is more narrow or has a more narrow portion where the clasps are attached.

These and other embodiments of the present invention may be realized in accordance with the above teachings and it should be evident that various modifications and changes may be made to the above described embodiments without departing from the broader spirit and scope of the invention. The specification and drawings are, accordingly, to be regarded in an illustrative rather than restrictive sense and the invention measured only in terms of the claims.

What is claimed is:

1. An identification assembly for a patient, comprising:

a band with first and second opposite ends and first and second opposite edges and a width measured between the first and second edges, the band being flexible to bring the first and second ends together to form a loop for encircling the patient, the band having a closure for securing the band into such a loop, the band comprising patient identification information; and a clasp secured to the band, the clasp comprising:

a first section having an inside surface and an outside surface;

a second section having an inside surface and an outside surface, the inside surface of the second section facing the inside surface of the first section; and a protrusion extending from one of the first or the second section to engage the other of the first or the second section to secure the first and second sections together in a closed position, wherein the outside surface of one of the first or the second section comprises a symbol integrally molded on the outside surface, the symbol providing an alert message distinct from the patient identification information, wherein the clasp is color-coded to provide information about the patient, and wherein the clasp is secured to the band independently of the closure.

2. The identification assembly of claim 1, wherein the clasp is secured to the band away from the closure.

3. The identification assembly of claim 1, wherein the band comprises an adhesive closure for securing the band into a loop.

4. The identification assembly of claim 1, wherein the first and second sections of the clasp are secured to each other at both the first and second opposite edges of the band.

5. The identification assembly of claim 4, wherein the first and second sections are secured to each other at a first securement point at the first edge of the band and at a second securement point at the second edge of the band, and wherein a distance between the first securement point and the second securement point is at least as great as the width of the band.

6. The identification assembly of claim 5, wherein the first securement point comprises the protrusion extending from the inside surface of one of the first or the second section.

7. The identification assembly of claim 6, wherein the second securement point comprises a hinge.

8. The identification assembly of claim 1, wherein the inside surface of one of the first or second section comprises a raised shelf.

9. The identification assembly of claim 8, wherein the distance between the protrusion and the shelf is at least as great as the width of the band.

10. The identification assembly of claim 1, wherein the inside surface of the first section comprises an alignment protrusion.

11. The identification assembly of claim 10, wherein the inside surface of the second section comprises an alignment recess corresponding to the alignment protrusion.

12. The identification assembly of claim 1, wherein the first and second sections have an outer perimeter that is tapered.

13. The identification assembly of claim 12, wherein the clasp is secured to the band from the first edge of the band, and further comprising a second tapered clasp secured to the band from the second edge of the band, the second clasp having a second symbol different from the first symbol.

14. The identification assembly of claim 1, further comprising a second clasp secured to the band, the second clasp being color-coded with a second color and having a second symbol integrally molded on an outside surface of the second clasp, the second symbol providing a second alert message that is different from the alert message provided on the first clasp.

15. The identification system of claim 1, wherein the clasp is integrally molded as one continuous piece.

16. The identification assembly of claim 1, wherein the clasp comprises a folding portion connecting the first and second sections, and wherein a distance between the folding portion and the protrusion is less than the width of the band.

17. The identification assembly of claim 1, wherein the band comprises a plurality of apertures, and wherein the protrusion of the clasp passes through at least one of the apertures.

18. An identification system to provide information about a patient, comprising:

an identification band for encircling such a patient;

a plurality of first clasps, each first clasp having a first section and a second section that engage each other to close the first clasp with the band passing between the first and second sections; and a plurality of second clasps, each second clasp having a first section and a second section that engage each other to close the second clasp with the band passing between the first and second sections, wherein each of the first clasps comprises a first color and a first symbol that provide information about the person, the first section of each first clasp being integrally molded with the first symbol, wherein each of the second clasps comprises a second color and a second symbol that provide information about the person, the first section of each second clasp being integrally molded with the second symbol, wherein the first color is different from the second color, and wherein the first symbol is different from the second symbol.

19. The system of claim 18, wherein the first clasps and the second clasps have a tapered outer perimeter, such that the clasps are capable of internesting on the band.

20. The system of claim 18, wherein at least one clasp is secured to the band.

21. The identification system of claim 18, wherein the first symbol comprises one of an allergy warning, a fall risk warning, and a do-not-resuscitate warning, and wherein the second symbol comprises a second of an allergy warning, a fall risk warning, and a do-not-resuscitate warning.

22. The identification system of claim 21, further comprising a plurality of third clasps comprising a third color and a third symbol comprising a third of an allergy warning, a fall risk warning, and a do-not-resuscitate warning, the third clasp being integrally molded with the third symbol.

23. The identification system of claim 18, wherein the first symbol comprises one of an allergy warning, a fall risk warning, a no latex warning, and a do-not-resuscitate warning, and wherein the second symbol comprises a second of an allergy warning, a fall risk warning, a no latex warning, and a do-not-resuscitate warning.

24. The identification assembly of claim 18, wherein the identification band comprises patient identification information that is distinct from the first and second symbols.

25. The system of claim 20, wherein the band comprises a plurality of apertures, and wherein the at least one clasp is secured through one of the apertures.

26. An identification assembly for a patient, comprising:
a band comprising:
first and second opposite ends; and
a strap portion having at least one aperture;
the band having an axis extending between the first and second ends,
the band being flexible to bring the first and second ends together to form a loop for encircling the patient;
a securement clasp for securing the band into a loop; and
an alert clasp secured to the strap portion of the band, the alert clasp being distinct from the securement clasp and comprising:
a first section;
a second section opposite the first section; and
a protrusion extending through the aperture to secure the first and second sections together with the strap portion extending between the first and second sections,
wherein the first section comprises a symbol providing an alert message about the patient, the alert message comprising an allergy warning, a do-not-resuscitate warning, or a fall risk warning, and
wherein the first section is coded by a color, and wherein the first section is pre-fabricated with the color and the symbol, prior to assembly of the alert clasp and the band with the patient.

27. The identification assembly of claim 26, wherein the alert clasp is integrally formed as one piece.

28. The identification assembly of claim 26, wherein the alert clasp further comprises a folding portion connecting the first and second sections, and wherein a distance between the folding portion and the protrusion is less than a width of the strap portion of the band.

29. The identification assembly of claim 28, wherein the band comprises identification information distinct from the alert information.

30. The identification assembly of claim 29, wherein an end of the first section opposite the folding portion is rounded.

31. The identification assembly of claim 30, wherein the folding portion comprises a hinge.

32. The identification assembly of claim 26, wherein the alert clasp has a tapered shape.

33. The identification assembly of claim 26, wherein the alert clasp is secured to the strap portion away from the first and second ends of the band.

34. The identification assembly of claim 26, further comprising a second alert clasp secured to the strap portion of the band, the second alert clasp comprising a second alert message different from the first alert message.

35. The identification assembly of claim 26, wherein the symbol is permanently imprinted on the first section of the alert clasp.

36. The identification assembly of claim 26, wherein the alert clasp is asymmetrical about the axis of the band when secured to the band.

37. An identification system for providing information about a patient, comprising:
a band comprising:
a display portion comprising an area for receiving identification information about such patient; and
a fastening portion comprising a top surface and a bottom surface and a closure for securing the band into a loop; and
a clasp attached to the fastening portion of the band, the clasp comprising:
a top portion on the top surface of the fastening portion of the band;
a bottom portion on the bottom surface of the fastening portion of the band;
a folding portion connecting the top and bottom portions; and
a message permanently formed on the top portion of the clasp, the message comprising one of an allergy warning, a do not resuscitate warning, and a fall risk warning,
wherein the clasp is color-coded with a color, and
wherein the clasp is distinct from the closure.

38. The identification assembly of claim 37, wherein the folding portion comprises a straight edge when the clasp is folded and secured to the band.

39. The identification system of claim 37, wherein the message comprises the allergy warning.

40. The identification system of claim 37, wherein the clasp further comprises a single post and a single aperture for connecting the top portion to the bottom portion with the fastening portion of the band passing between the top portion of the clasp and the bottom portion of the clasp.

41. The identification system of claim 40, wherein a distance between the post and the folding portion is less than a width of the fastening portion of the band.

42. The identification system of claim 39, wherein the clasp is integrally molded as one continuous piece.

43. The system of claim 37, wherein the top portion has a tapered shape.

44. The system of claim 37, wherein the closure comprises a mechanical or an adhesive closure.

45. A system for providing an alert message about a patient, the system comprising: a band with a non-reusuable closure for encircling an extremity of such a patient, a plurality of first clasps securable to the band, each first clasp having a first color and a first alert message comprising an allergy warning; a plurality of second clasps securable to the band, each second clasp having a second color and a second alert message comprising a do not resuscitate warning; and a plurality of third clasps securable to the band, each third clasp having a third color and a third alert message comprising a fall risk warning, wherein the first color, the second color, and the third color are different from each other; wherein the first clasps, second clasps and third clasps are securable to the band independent of the closure, and wherein each of the first, second, and third clasps is pre-fabricated with the respective color and the respective alert message prior to identification of the patient.

46. The system of claim 45, wherein each clasp comprises a post and wherein each post is dimensioned to pass through an aperture in such band to secure the clasp to the band.

47. The system of claim 45, wherein each of the first, second, and third clasps is integrally molded as one continuous plastic piece.

48. The system of claim 45, wherein the first, second, and third alert messages are each permanently imprinted on the respective first, second, and third clasps.

* * * * *